US006802379B2

(12) United States Patent
Dawson et al.

(10) Patent No.: US 6,802,379 B2
(45) Date of Patent: Oct. 12, 2004

(54) LIQUID LIFT METHOD FOR DRILLING RISERS

(75) Inventors: Charles Rapier Dawson, Houston, TX (US); Yuh-Hwang Tsao, Houston, TX (US); Sandra Nowland Hopko, Katy, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 10/081,054

(22) Filed: Feb. 21, 2002

(65) Prior Publication Data

US 2002/0117332 A1 Aug. 29, 2002

Related U.S. Application Data

(60) Provisional application No. 60/271,304, filed on Feb. 23, 2001.

(51) Int. Cl.[7] ..... E21B 44/00

(52) U.S. Cl. ..... 175/38; 175/70; 175/206

(58) Field of Search ..... 175/71, 38, 65, 175/66, 70, 72, 206, 207; 166/356, 357, 367

(56) References Cited

U.S. PATENT DOCUMENTS

| | | | | |
|---|---|---|---|---|
| 2,512,783 A | | 6/1950 | Tucker | 255/2 |
| 2,808,230 A | | 10/1957 | McNeill et al. | 255/2.5 |
| 2,923,531 A | | 2/1960 | Bauer et al. | 255/2.5 |
| 3,434,550 A | | 3/1969 | Townsend, Jr. | 175/5 |
| 3,465,817 A | | 9/1969 | Vincent | |
| 3,603,409 A | | 9/1971 | Watkins | 175/7 |
| 3,815,673 A | | 6/1974 | Bruce | |
| 3,955,411 A | | 5/1976 | Lawson, Jr. | 73/155 |
| 4,046,191 A | | 9/1977 | Neath | |
| 4,060,140 A | | 11/1977 | Barrington | 175/7 |
| 4,091,881 A | | 5/1978 | Maus | 175/7 |
| 4,099,583 A | | 7/1978 | Maus | 175/7 |
| 4,134,461 A | | 1/1979 | Blomsma | 175/9 |
| 4,210,208 A | | 7/1980 | Shanks | 166/352 |
| 4,291,772 A | | 9/1981 | Beynet | 175/5 |
| 5,873,420 A | | 2/1999 | Gearhart | 175/25 |
| 6,065,550 A | | 5/2000 | Gardes | 175/62 |
| 6,197,095 B1 | * | 3/2001 | Ditria et al. | 95/248 |
| 6,277,286 B1 | * | 8/2001 | Sontvedt et al. | 210/744 |
| 6,328,107 B1 | * | 12/2001 | Maus | 166/335 |
| 6,530,437 B2 | | 3/2003 | Mauer et al. | 175/5 |
| 6,536,540 B2 | * | 3/2003 | de Boer | |
| 2002/0108782 A1 | | 8/2002 | de Boer | 175/7 |

FOREIGN PATENT DOCUMENTS

| | | |
|---|---|---|
| CA | 2148969 | 11/1996 |
| GB | 1132687 | 11/1968 |
| WO | WO 99/15758 | 4/1999 |
| WO | WO 99/18327 | 4/1999 |
| WO | WO 99/49172 | 9/1999 |
| WO | WO 00/04269 | 1/2000 |
| WO | WO 02/48063 | 6/2002 |

OTHER PUBLICATIONS

Brookey, Tom, 1998, "Micro–Bubbles": New Aphron Drill–In Fluid Technique Reduces Formation Damages in Horizontal Wells, SPE 39589, Feb. 18–19, 1998, pp. 645–656.

(List continued on next page.)

*Primary Examiner*—Roger Schoeppel

(57) ABSTRACT

A method for drilling a well below a body of water as disclosed which includes injecting into the well, at a depth below the water surface, a liquid having a lower density than a density of a drilling mud producing a mixture of drilling mud and low-density liquid in the well. The mixture of drilling mud and low-density liquid is withdrawn from an upper end of the well. The drilling mud and the low-density liquid are separated, with at least a portion of the separated low-density liquid returned to the depth below the water surface and at least a portion of the separated drilling mud returned to an upper end of the drill string.

20 Claims, 4 Drawing Sheets

OTHER PUBLICATIONS

Choe, Jonggeun, 1999, "Analysis of Riserless Drilling and Well–Control Hydraulics", SPE Drill & Completions, SPE 55056, Mar. 1999, pp. 71–81.
Gaddy, Dean E., 1999, "Industry Group Studies Dual–Gradient Drilling", Oil & Gas Journal, Aug. 16, 1999, pp. 32–34.
Gault, Allen, 1996, "Riserless Drilling: Circumventing the Size/Cost Cycle in Deepwater", Offshore, May 1996, pp. 49–54.
Medley, George H., et al, 1995, "Development and Testing of Underbalanced Drilling Products", Topical Report, DOE/MC/31197–5129, Sep. 1995.
Nessa, D. O., et al, 1997, "Offshore Underbalanced Drilling System Could Revive Field Developments—Part I", World Oil, Jul. 1997, pp. 61–66.
Nessa, D. O., et al, 1997, "Offshore Underbalanced Drilling System Could Revive Field Developments—Part II", World Oil, Oct. 1997, pp. 83–88.
Sangesland, S., et al, 1998, "Riser Lift Pump for Deep Water Drilling", IADO/SPE Asia Pacific Drilling Conference, Jakarta, Indonesia, Sep. 7–9, 1998, IADC/SPE 47821, pp. 299–309.
Shaughnessy, J. M. & Herrmann, Robert P., 1998, "Concentric Riser Will Reduce Mud Weight Margins, Improve Gas–Handling Safety", Oil & Gas Journal, Nov. 2, 1998, pp. 54–58.
Snyder, R. E., 1998, "Riserless Drilling Project Develops Critical New Technology", World Oil, Jan. 1998, pp. 73–77.
Westermark, R. V., 1986, "Drilling With a Parasite Aerating String in the Disturbed Belt, Gallatin County, Montana", IADC/SPE 14734, IADC/SPE 1986 Drilling Conference, Dallas, TX, Feb. 10–12, 1986, pp. 137–143.
Gault, Allen, 1996, "Riserless Drilling: Circumventing the Size/Cost Cycle in Deepwater", Offshore, May 1996, pp. 49–54.
Goldsmith, Riley, 1998, "MudLift Drilling System Operations", OTC 8751, 1998 Offshore Tech. Conference, Houston, TX, May 4–7, 1998, pp. 317–325.
Lopes, Clovis A., et al, 1997, "Feasibility Study of a Dual Density Mud System for Deepwater Drilling Operations", 1997 Offshore Tech. Conf., Houston, TX, May 5–8, 1997, pp. 257–266.
Lopes, Clovis A., et al, 1997, "The Dual Density Riser Solution", SPE/IADC Drilling Conference, Amsterdam, SPE/IADC 27628, Mar. 6–7, 1997, pp. 479–487.
Medley, George H., et al, 1995, "Use of Hollow Glass Spheres for Underbalanced Drilling Fluids", SPE Tech. Conference, Dallas, TX, Oct. 22–25, 1995, pp. 511–520.

* cited by examiner

LIQUID LIFT METHOD FOR DRILLING RISERS

CROSS-REFERENCE TO RELATED APPLICATIONS

This application claims priority benefit from U.S. provisional application No. 60/271,304 filed on Feb. 23, 2001.

FIELD OF THE INVENTION

The invention relates generally to offshore drilling systems. More particularly, the invention relates to a dual-gradient offshore drilling system using low-density liquid lift for drilling risers.

BACKGROUND OF THE INVENTION

The search for crude oil and natural gas in deep and ultra-deep water has resulted in greater use of floating drilling vessels. These vessels may be moored or dynamically-positioned at the drill site. Deep water drilling typically involves the use of marine risers. A riser is formed by joining sections of casing or pipe. The riser is deployed between the drilling vessel and wellhead equipment located on the sea floor and it is used to guide drill pipe and tubing to the wellhead and to conduct a drilling fluid and earth-cuttings from a subsea wellbore back to the floating vessel. A drill string is enclosed within the riser pipe. The drill string includes a drilling assembly that carries a drill bit.

A suitable drilling fluid (commonly called "drilling mud" or "mud") is supplied or pumped under pressure from the drilling vessel. This drilling mud discharges at the bottom of the drill bit. Mud lubricates and cools the bit, and lifts drill cuttings out of the wellbore. In conventional offshore drilling, drilling mud is circulated down the drill string and up through an annulus between the drill string and the wellbore below the mudline (sea floor), and from the mudline to the surface through the riser/drill string annulus.

Drilling mud is very important in the drilling process. It serves as: (1) a lubrication and heat transfer agent; (2) a medium to carry away and dislodge pieces of the formation cut by the drill bit; and (3) a fluid seal for crucial well control purposes. To maintain well control, drilling operators attempt to carefully control the mud density at the surface of the well to avoid many potential problems. One potential problem is "lost circulation" when a column of drilling mud exerts excess hydrostatic pressure, which propagates a fracture in the formation. Formation fluids may enter the wellbore unexpectedly when the hydrostatic pressure falls below the formation pressure. Such an event is called "taking a kick." A blowout occurs when the formation fluid enters the wellbore in an uncontrolled manner. Both of these problems become even more difficult to overcome in deep water. In a conventional drilling system, the relative density of the drilling mud over that of the seawater, along the length of the riser in deep water, combined with a low overburden pressure, results in excess hydrostatic pressure in the riser/drill string annulus and the wellbore/drill string annulus.

Because of the narrow margins between pore pressure (formation fluid pressure) and fracture pressures (leak-off/lost circulation pressures), equivalent circulating density (ECD) is tightly controlled by balancing hole cleaning requirements and circulation rates. The wellbore is also cased off at frequent intervals to maintain well control.

One solution to these problems known in the art is dual-gradient drilling. Dual-gradient drilling is an area of technology that is primarily used to overcome the narrow pore pressure/fracture gradient margins found in abnormally pressured, ultra-deepwater wells. As an enabling technology, dual-gradient drilling permits drilling in deep and ultra deep water using fewer casing strings than possible using conventional drilling systems. Because there are fewer casing strings used, there is potential for drilling dual-gradient wells faster than conventionally drilled wells. Dual-gradient drilling can also enhance extended-reach drilling by reducing the influence of circulating pressure losses on bottom-hole pressure. Dual-gradient drilling can be used to drill a wellbore with a larger diameter hole at the bottom of the wellbore, resulting in lower pressure drop per unit length than a smaller diameter wellbore.

Forms of dual-gradient drilling technology being developed include pump-lifted and gas-lifted drilling risers. Pump-lift systems use pumps positioned near the sea floor to pump the heavy mud/drilling returns from the mud line to the drilling vessel to reduce the hydrostatic pressure at the mud line, generally to that which would result from a sea water gradient. Illustrative of the pump-lift systems is U.S. Pat. No. 4,813,495 to Leach that discloses a method and apparatus for drilling subsea wells in water depths exceeding 3000 feet (915 meters) (preferably exceeding 4000 feet (1220 meters)) where drilling mud returns are taken at the seafloor and pumped to the surface by a centrifugal pump that is powered by a seawater driven turbine. See also U.S. Pat. No. 4,149,603 to Arnold and published PCT application WO9915758. Limitations with the pump-lift systems include wear and equipment reliability for the subsea pumps and motors. Also, the ability of the pump-lift system to handle dissolved and entrained gas is potentially very poor.

Gas-lift systems use air or nitrogen to "lift" the drilling returns, effectively lowering the riser hydrostatic pressure to a seawater pressure gradient. For example, U.S. Pat. No. 4,099,583 to Maus discloses an offshore drilling method and apparatus which are useful in preventing formation fracture caused by excessive hydrostatic pressure of the drilling fluid in a drilling riser. One or more flow lines are used to withdraw drilling fluid from the upper portion of the riser pipe. Gas injected into the flow lines substantially reduces the density of the drilling fluid and helps provide the lift necessary to return the drilling fluid to the surface. The rate of gas injection and drilling fluid withdrawal can be controlled to maintain the hydrostatic pressure of the drilling fluid remaining in the riser and wellbore below the fracture pressure of the formation. See also U.S. Pat. No. 3,815,673 to Bruce, et al., U.S. Pat. No. 4,063,602 to Howell, et al. and U.S. Pat. No. 4,091,881 to Maus. Limitations with the gas-lift system include inefficient or ineffective cuttings transport, dealing with pressurized equipment on the drilling vessel, and detection of fluid influx from the formation to the well bore (kick detection).

SUMMARY OF THE INVENTION

Generally, the invention is a method of drilling a well below a body of water using a drill string that starts by injecting into the well, at a depth below the water surface, a liquid having a lower density than a density of a drilling mud. This produces a mixture of drilling mud and low-density liquid in the well. The low-density liquid may be miscible or immiscible with the drilling mud. The mixture of drilling mud and low-density liquid is withdrawn from an upper end of the well. At least a portion of the low-density liquid is separated from the mixture of drilling mud and low-density liquid, with at least a portion of the separated low-density liquid returned to the depth below the water surface and at least a portion of the drilling mud depleted of low-density liquid being returned to an upper end of the drill string.

An embodiment of the invention includes controlling the injection rate of the liquid. First, the rate of the liquid injected can be selected so the cuttings within the riser pipe have an upward velocity in excess of the settling rate of the cuttings in the riser pipe. Secondly, the rate of the liquid injected can be selected so the liquid lift maintains a bottom-hole pressure that is below the fracture pressure of the earth formation and above the pore pressure of the formation.

Other aspects and advantages of the invention will be apparent from the following description and the appended claims.

DETAILED DESCRIPTION OF THE INVENTION

Figure 1:
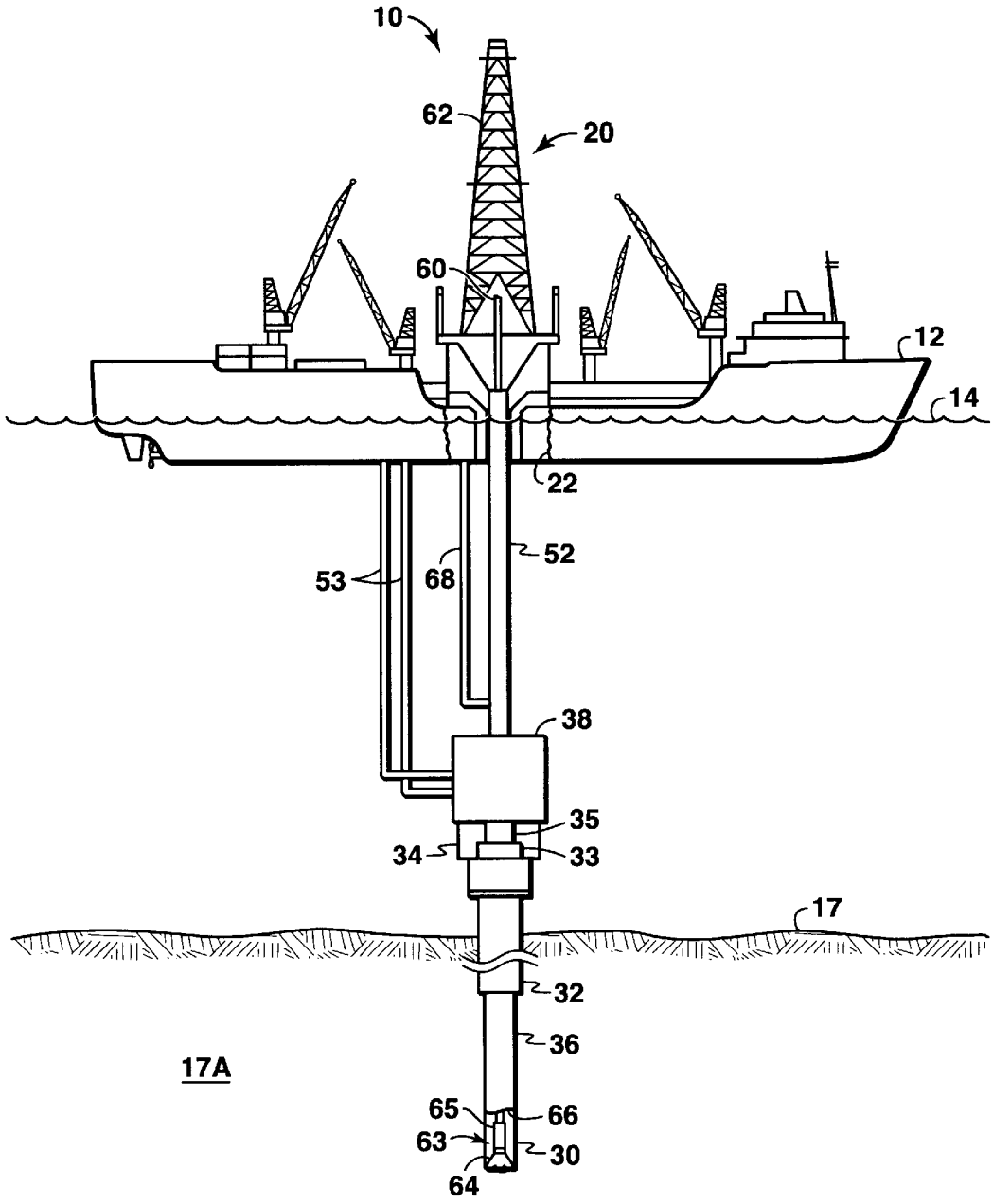
FIG. 1 (PRIOR ART)
FIG. 1 illustrates an offshore drilling system configured for dual gradient riser drilling.

Specific embodiments of the invention will now be described in detail with reference to the accompanying figures. Like elements in the various figures are denoted by like reference numerals for consistency.

FIG. 1 illustrates one type of offshore drilling system (10) where a drilling vessel (12) floats on a body of water (14) which overlays a pre-selected earth formation (17A). A drilling rig (20) is positioned in the middle of the drilling vessel (12), above a moon pool (22). The moon pool (22) is a walled opening that extends through the drilling vessel (12) and through which drilling tools are lowered from the drilling vessel (12) to the sea floor or mudline (17). At the mudline (17), a structural pipe (32) extends into a wellbore (30). A conductor housing (33) is attached to the upper end of the conductor pipe (32). A guide structure (34) is installed around the conductor housing (33) and adjacent a blowout preventor (38) before the conductor housing (33) is run to the mudline (17). A wellhead (35) is attached to the upper end of a conductor pipe (36) that extends through the structural pipe (32) into the wellbore (30). The wellhead (35) is of conventional design and provides a facility for hanging additional casing strings in the wellbore (30).

A riser system like the one depicted in FIG. 1 typically includes one or more auxiliary lines (well-control lines 53 and boost line 68) on the outside of a riser (52). Well control lines (53) provide a high-pressure conduit for fluid flow between a BOP (38) and a drilling rig (20). A boost line (68) supplies drilling fluid to the bottom of a riser (52) to enhance the removal of drill cuttings.

A drill string (60) extends from a derrick (62) on the drilling rig (20) into the wellbore (30) through a riser (52) which extends generally from the blowout preventor (38) back to the drilling vessel (12). Attached to the end of the drill string (60) is a bottom hole assembly (63), which typically includes a drill bit (64) and one or more drill collars (65). The bottom hole assembly (63) may also include stabilizers, mud motor, and other selected components required to drill a wellbore (30) along a planned trajectory, as is well known in the art. The end result is the creation of a well that extends from above the water surface to below the mudline (17) into the earth formation (17A). During conventional drilling operations, drilling mud is pumped down the bore of the drill string (60) by a surface pump (not shown) and is forced out of the nozzles (not shown) of the drill bit (64) into the bottom of the wellbore (30). Cuttings resulting from the drilling become entrained in the mud at the bottom of the wellbore (30) and the mud laden with cuttings rises up the wellbore annulus (66) and into the riser/drill string annulus (54 in FIG. 3), and to the surface for treatment in mud cleaning facilities (not shown). The passage of the mud from the bottom of the wellbore to the surface of the body of water may be referred to as a return flow system.

The present invention is not limited to any particular return flow system. In one embodiment, the return flow system may comprise a first annular space between the drill string (60) and the wall of the wellbore (30), and a second annular space between the drill string (60) and the inner surface of casing (36) positioned in the wellbore, and a third annular space between the drill string (60) and the riser (52) extending between the cased wellbore and the surface of the body of water (14).

Figure 2:
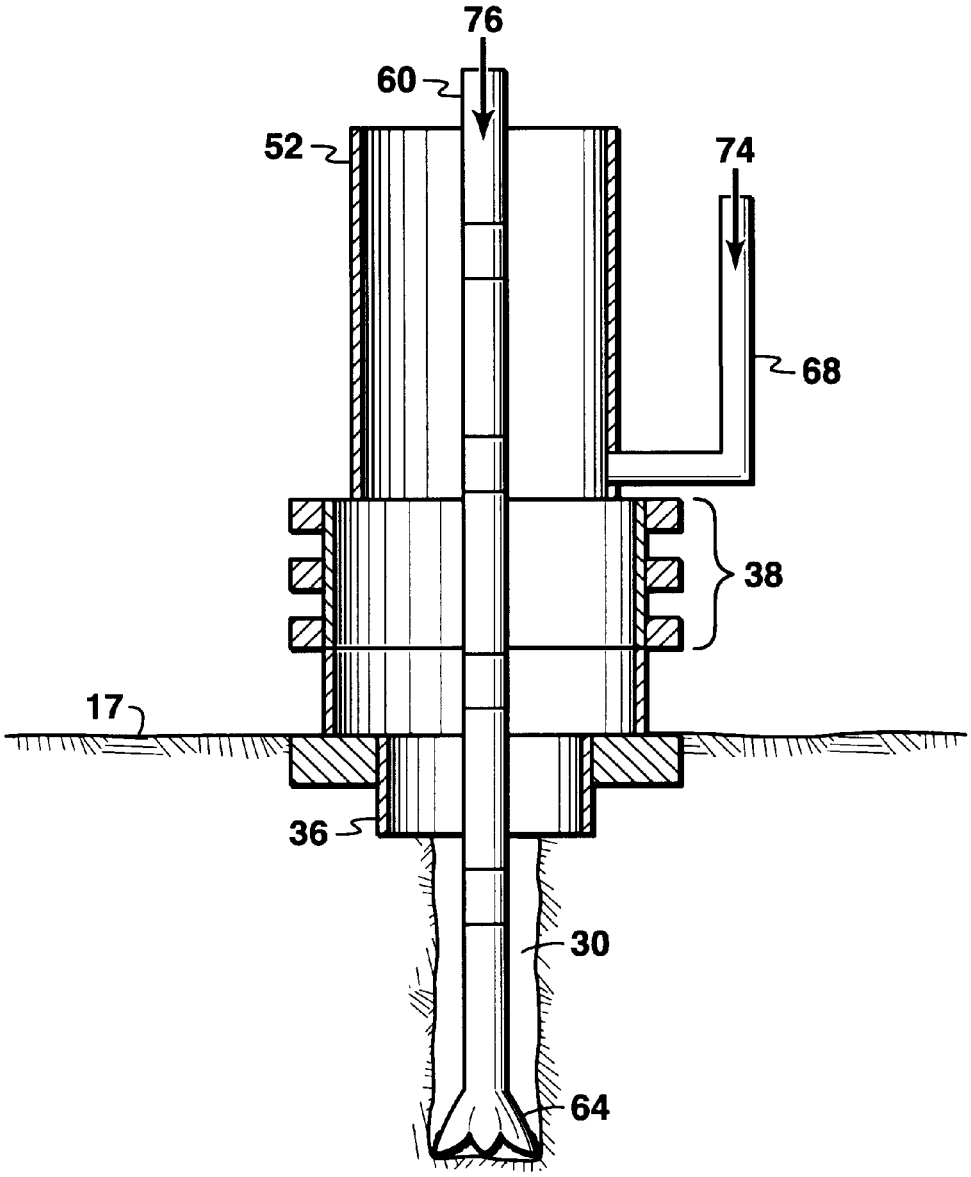
FIG. 2 illustrates a liquid lift system for drilling risers in accordance with one embodiment of the present invention.

A liquid-lift drilling riser system, as shown in FIG. 2, uses a lightweight miscible or immiscible fluid to reduce the density of a drilling mud to as low as that of seawater. A surface pump (not shown) pumps a low-density liquid (74) through a riser boost line (68). The low-density liquid (74) is directed to the riser (52) approximately at the mud line (17) via the riser boost line (68). During normal drilling, the low-density liquid (74) will mix with the high-density mud (76) returning from the bottom of the well. This mixture (80) will return to the surface and flow over shale shakers (not shown). Once through the shale shakers (not shown), the mixture (80) will be separated and treated into its original low-density liquid (74) and high-density mud (76) components. The high-density mud (76) (preferably substantially all of the high-density mud which is depleted of low-density liquid 21) will again be pumped down the drill string (60) and the low-density liquid (74) (preferably substantially all of the separated low-density liquid 74) will again be pumped down the riser boost line (68) back to the bottom of the riser (52). Proper separation provides a closed loop system with low fluid losses.

Figure 3:
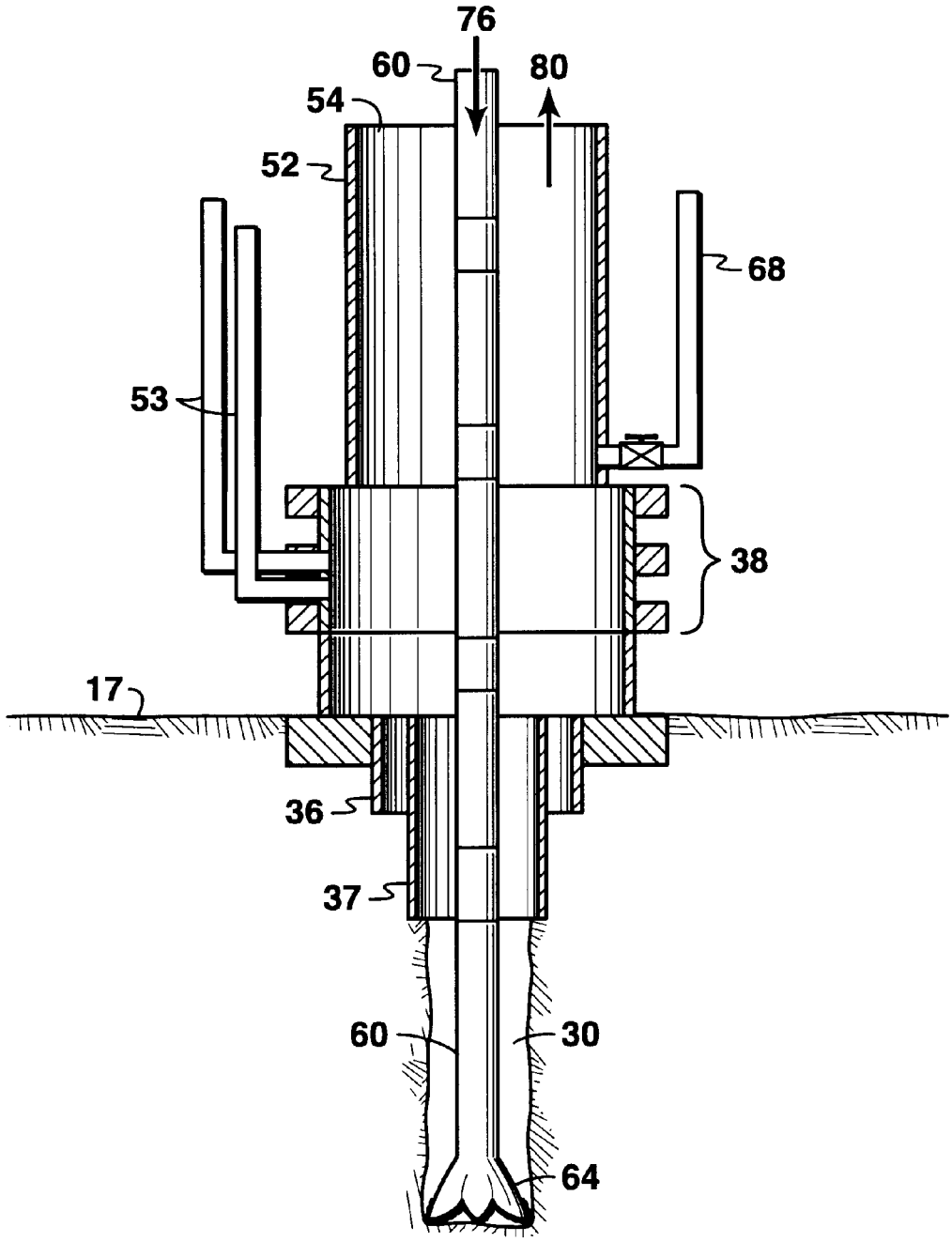
FIG. 3 illustrates mud processing in a liquid lift system for drilling risers in accordance with one embodiment of the present invention.

FIG. 3 shows an alternative configuration for a liquid lift drilling system. A lightweight miscible or immiscible fluid is used to reduce the density of a drilling mud to as low as that of seawater. A surface pump (not shown) pumps a low-density liquid (74) through a fluid injection line (72). The low-density liquid (74) is directed to a position below the mud line (17) via a parasite string (71) installed in the cased wellbore (37). The parasite string thereby placing the low-density liquid 74 in an annular space between the drilling string 60 and the inner wall of casing 36. During normal drilling, the low-density liquid (74) will mix with the high-density mud (76) returning from the bottom of the well. This mixture (80) will return to the surface and flow over shale shakers (not shown). Once through the shale shakers (not shown), the mixture (80) will be substantially separated and treated into its original low-density liquid (74) and high-density mud (76) components. The high-density mud (76) will again be pumped down the drill string (60) and the low-density liquid (74) will again be pumped down the fluid injection line (68) through the parasite string (71) to the cased wellbore (37).

In one embodiment, a miscible liquid-lift system uses a miscible liquid such as seawater to be injected into a water-based mud. For lifting a water-based drilling mud, seawater is injected into the riser boost line (68) to dilute the mud, effectively reducing mud density (weight). A portion of a return fluid is discarded at surface, and the water-based drilling mud is rebuilt with necessary additives needed to regain the desired mud weight.

For lifting a weighted mud, or if drilling with a synthetic or an oil-based mud, it may not be economical or environmentally acceptable to discard diluted drilling mud at surface. In such a case, the miscible liquid-lift system can comprise a base fluid common to both the low-density liquid (74) and the high-density mud (76). The high-density mud (76) generally contains barite, hematite and/or other suitable weighting agents and is directed down the drill string (60) as previously explained. The low-density liquid (74) may contain one or more density-reducing agents, such as low-density particulate materials, including, for example, hollow glass beads/microspheres or other density-reducing additive. As previously explained, the low-density liquid (74) is directed to the riser (52) at the mud line (17) via the riser boost line (68 in FIG. 2), or is directed into the wellbore (37 in FIG. 3) via a parasite string (71 in FIG. 3). The fluid mixture (80) returning up the riser pipe (52) contains both weighting agents and weight-reducing agents (if any).

Figure 4:
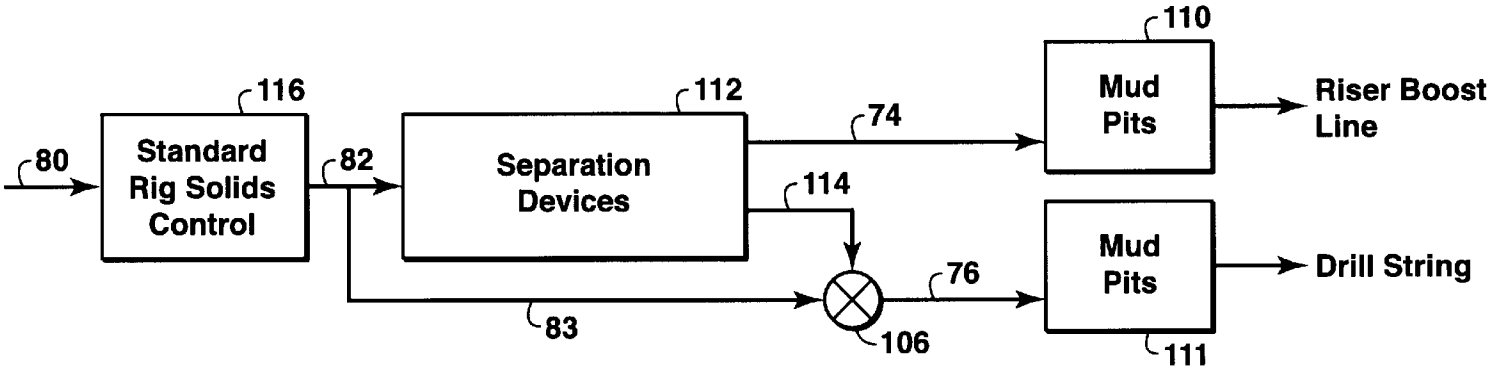
FIG. 4 depicts a flowchart of miscible liquid lift in accordance with one embodiment of the present invention.

Referring to FIG. 4, drill solids are removed from the return fluid mixture (80) using one or more standard rig solids control devices (116). The resulting fluid (82) then travels to one or more separation devices (112), such as mechanical separators, gravity separators, centrifuges, or other similar equipment. The one or more separation devices (112) separate the fluid (82) into the low-density liquid (74) and weighting agent (114). The low-density liquid (74) is moved to mud pits (110) before being redirected into the riser annulus (54 in FIG. 2) above the BOP (38 in FIG. 2) or into wellbore annulus (37 in FIG. 3) below the mud line (17 in FIG. 3). The high-density mud (76) is re-formulated at (106) by combining the weighting agent (114) and a portion (83) of unprocessed fluid (82). Then, the reformulated high-density mud (76) may be moved to mud pits (111) for temporary storage before being redirected into the wellbore (30 in FIG. 2). The miscible liquid-lift system can be used for any type of drilling fluid, and this embodiment of the liquid-lift system can be used to drill part or all of the well.

Figure 5:
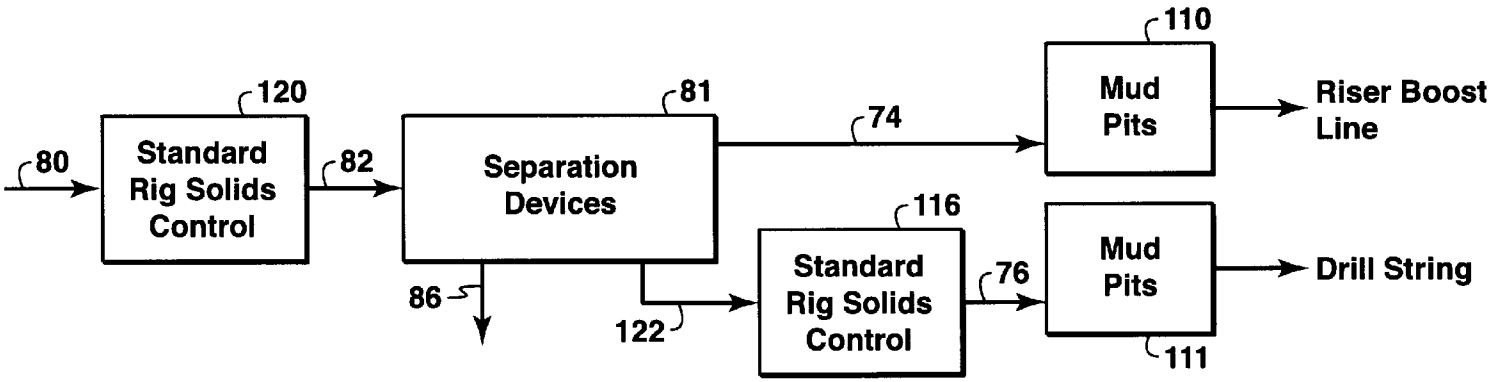
FIG. 5 depicts a flowchart of immiscible liquid lift in accordance with one embodiment of the present invention.

Another embodiment is an immiscible liquid-lift system. Referring to FIG. 5, an immiscible system uses a low-density boost liquid (74) that is substantially immiscible with the high-density mud (76) to lighten the returning drill fluid. An example of this is to drill with a weighted water-based mud and boost with a lightweight, immiscible synthetic fluid, such as an ester, olefin or glycol. The low-density liquid (74) is introduced into the returning drill fluid at the base of the riser (52 in FIG. 2) or down the fluid injection string (72 in FIG. 3) or both the base of the riser (52 in FIG. 2) and down the injection string (72 in FIG. 3) simultaneously. The resulting fluid (80) is a stable, two-phase fluid of lower density than the mud (76). Referring to FIG. 5, one or more conventional separation devices (81), such as a three-phase centrifuge, can be used to separate the fluid mixture (80) on the drilling vessel (12 in FIG. 1), where the fluids (74, 76) can be re-circulated. First, the fluid mixture (80) can be processed using standard solids control equipment (120), such as course-screen shakers, to remove part or substantially all of the drill solids. Next, the resulting fluid (82) is separated in oil-water separator (81), such as a three-phase centrifuge, to produce drill solids (86), low-density liquid (74), and drill fluid (122). The drill solids (86) may be discarded in any environmentally suitable manner. The low-density liquid (74) may be moved to mud pits (110) for temporary storage. The drilling fluid (122) in this embodiment may pass through additional standard rig solids control devices (116), and then moved to mud pits (111) for temporary storage as high-density mud (76).

Another embodiment of the liquid lift system uses a combination fluid, such as low-density glass beads (or a density-reducing agent) in a miscible low-density liquid slurry. By using miscible low-density liquid slurry instead of the low-density mud without the slurry, the volume of low-density liquid needed for producing a significant mud weight change in the riser (52 in FIG. 2) may be reduced. The density-reducing agent may be recovered at the surface before discarding the excess volume of fluid, if any. The result is a stable, homogeneous fluid of lower density than the mud pumped down the drill string (60 in FIG. 1).

Referring to FIG. 2, controlling the rate of the low-density liquid (74) injected into the riser (52) at or near the mud line (17) via the riser boost line (68), or directed into the cased wellbore (37 in FIG. 3) via the fluid injection string (72 in FIG. 3) has two primary purposes in the liquid-lift system. First, the rate of the liquid injected can be controlled so the cuttings within the riser pipe annulus (54) have an upward velocity in excess of the settling rate of the cuttings in the riser pipe (52). Secondly, the rate of the low-density liquid (74) injected can be controlled to maintain a bottom-hole pressure that is below the fracture pressure of the earth formation and above the pore pressure of the formation.

The liquid-lift system has several advantages over pump-lift and gas-lift systems. The liquid-lift system can use conventional solids control equipment and rig pumps to produce a simpler, more reliable dual-gradient drilling system than a pump-lift system. Cuttings transport is conventional, kick detection is conventional, circulation can be stopped (remain static) without adverse consequences, and there is little or no additional subsea equipment to break down, thereby creating a need for a riser trip to repair.

The liquid-lift system also allows the switching of drilling from dual-gradient to conventional, single-gradient merely by ceasing the injection of the low-density boost fluid to the riser (52 in FIG. 2). The liquid-lift system also allows for additional injection/lift points than just the mud line. The use of a parasite string (71 in FIG. 3) to inject lift fluid below the mud line (17 in FIG. 3) increases the effectiveness of the liquid-lift system and provides incentive for use of dual-gradient drilling in shallow water or on land. Additionally, by using the parasite string to inject the lift fluid below the mudline (17 in FIG. 3), the volume of lift fluid necessary to create lift in the riser (52 in FIG. 3) can be reduced.

While the invention has been described with respect to a limited number of embodiments, those skilled in the art will appreciate that other embodiments can be devised which do not depart from the scope of the invention as disclosed herein. Accordingly, the scope of the invention should be limited only by the attached claims.

What is claimed is:

1. A method of drilling a well below a body of sea water in which a drill bit is rotated at the end of a drill string, comprising:

(a) injecting into the well at a depth below the water surface a liquid having a lower density than a density of a drilling mud producing a mixture of drilling mud and low-density liquid in the well;

(b) withdrawing the mixture of drilling mud and low-density liquid from the well wherein the mixture has a density greater than the sea water at the seafloor surrounding the well;

(c) separating at least a portion of low-density liquid from the mixture of drilling mud and low-density liquid, thereby producing a drilling mud depleted of low-density liquid;

(d) returning at least a portion of the separated low-density liquid to the depth below the water surface; and (e) returning at least a portion of the drilling mud depleted of low-density liquid to an upper end of the drill string.

2. The method of claim 1, wherein the low-density liquid is immiscible with the drilling mud.

3. The method of claim 2, wherein the drilling fluid is water-based and the low-density liquid is at least one of oil-based, synthetic and non-aqueous liquid.

4. The method of claim 2, wherein the low-density liquid comprises density-reducing particulate material.

5. The method of claim 1, wherein the low-density liquid is miscible with the drilling mud.

6. The method of claim 1, wherein separating comprises:

at least one of mechanical separation, gravity separation and centrifugal separation.

7. The method of claim 1, further comprising:

controlling a rate of the liquid injecting so that a bottom-hole pressure in the well is below a fracture pressure of an earth formation and above a pore pressure of the formation.

8. The method of claim 1, further comprising:

controlling a rate of the liquid injecting into the lower end of riser so the cuttings within the riser pipe have an upward velocity in excess of the settling rate of the cuttings in the riser pipe.

9. The method of claim 1, wherein the low-density liquid comprises density-reducing particulate material.

10. The method of claim 1, further comprising:

ceasing the injection of the low-density fluid into the well at a depth below the water surface to switch from dual-gradient drilling to conventional drilling.

11. The method of claim 1, wherein substantially all of the separated low-density liquid is returned to the depth below the water surface, and substantially all of the separated drilling mud is returned to the upper end of the drill string in a closed system.

12. The method of claim 1, wherein the depth below the water surface is between the drill string and the wellbore at a position below a wellhead.

13. The method of claim 1, wherein the depth below the water surface is at a lower end of a riser pipe that extends from a drilling vessel on the surface of the ocean downwardly to wellhead equipment on the sea floor.

14. The method of claim 1, wherein the low-density liquid is injected via a parasite string into an annular space between the drill string and a casing's inner wall at a position below a wellhead.

15. The method of claim 1, wherein the low-density liquid is injected into a lower end of a riser pipe that extends from a drilling vessel on the surface of the body of water downwardly to wellhead equipment on the floor of the body of water.

16. The method of claim 9, wherein the particulate material comprises low-density glass beads.

17. The method of claim 9, wherein the particulate material comprises low-density microspheres.

18. A method of treating a drilling fluid used in drilling a wellbore in a earth formation below a body of water in which a drill string extends from a water-surface drilling facility into the wellbore and the drilling fluid passes through the drill string and flows from the drill string into the wellbore whereby cuttings resulting from the drilling becomes entrained in the drilling fluid and the drilling fluid with the entrained cuttings returns to the surface of the body of water by means of a return flow system, comprising (a) injecting into the return flow system at a depth below the surface of the body of water a liquid having a density lower than a density of the drilling fluid, thereby producing in a return flow system a mixture of drilling fluid and a low-density liquid;

(b) withdrawing the mixture of drilling fluid and low-density liquid from an upper end of the return flow system wherein the mixture has a density greater than the seawater at the seafloor surrounding the well;

(c) separating at least a portion of the low-density liquid from the mixture of drilling fluid and low-density liquid, thereby producing a drilling fluid depleted of low-density liquid;

(d) returning at least a portion of the separated low-density liquid to the return flow system to the depth below the water surface; and (e) returning at least a portion of the drilling fluid depleted of low-density liquid to the drill string.

19. The method of claim 18 in which the return flow system comprises a first annular space between the drill string and the wall of the wellbore, and a second annular space between the drill string and the inner wall of a casing positioned in the wellbore, and a third annular space between the drill string and a riser extending between the cased wellbore and the surface of the body of water, wherein the return of the separated low-density liquid of step (d) is to the annular space at the lower end of the third annular space.

20. The method of claim 18 in which the return flow system comprises a first annular space between the drill string and the wall of the wellbore, a second annular space between the drill string and the inner wall of a casing positioned in the wellbore, and a third annular space between the drill string and a riser extending between the cased wellbore and the surface of the body of water, wherein the return of the separated low-density liquid of step (d) is to the second annular space.

* * * * *